United States Patent [19]

Maynard

[11] 4,239,441

[45] Dec. 16, 1980

[54] SUPPORT FOR TOOL HANDLING BOOM

[75] Inventor: James J. Maynard, Marcellus, N.Y.

[73] Assignee: Syracuse Supply Company, Syracuse, N.Y.

[21] Appl. No.: 32,369

[22] Filed: Apr. 23, 1979

[51] Int. Cl.[3] ..... F27D 3/15

[52] U.S. Cl. ..... 414/587; 266/228; 414/696; 414/720

[58] Field of Search ..... 414/198, 214, 215, 586, 414/587, 688, 696, 718, 719, 722, 727, 720, 686, 685, 680; 266/228, 287; 173/43; 182/19, 68; 299/36; 212/35 HC, 58 R, 59 R, 59 A, 55, 8 R; 264/30

[56] References Cited

U.S. PATENT DOCUMENTS

| | | | |
|---|---|---|---|
| 861,292 | 7/1907 | Landis | 414/215 X |
| 2,345,572 | 4/1944 | Brosius | 414/586 |
| 3,913,756 | 10/1975 | Barron et al. | 414/718 X |
| 4,045,923 | 9/1977 | Shanmugasundaram | 212/55 X |

*Primary Examiner*—James L. Rowland

*Attorney, Agent, or Firm*—Bruns & Jenney

[57] ABSTRACT

Apparatus for supporting an extendable, elongated tool-handling boom within a gantry. The back end of the boom is rotatably supported in a carriage that is movably mounted in a gantry while the main body of the boom forward of the carriage is seated upon a rest carried within a cradle which is also movably mounted within the gantry whereby the relative position of the two boom support points can be altered as the boom is extended and retracted within the gantry. The boom is able to be lifted from the cradle seat in the event it becomes hung-up upon an obstacle while in use thereby preventing the boom from being damaged. A shock absorber is operably connected between the cradle and the boom which serves to return the boom to the cradle seat at a controlled rate.

14 Claims, 8 Drawing Figures

SUPPORT FOR TOOL HANDLING BOOM

BACKGROUND OF THE INVENTION

This invention relates to apparatus for supporting an elongated tool-handling boom and, in particular, to apparatus for preventing a tool-handling boom from being damaged in the event the boom becomes fouled with an obstacle while in use.

Most tool-handling booms presently used for conditioning materials in furnaces or the like are relatively rigid structures that are incapable of absorbing shock-like loads which are typically generated when the boom strikes or becomes hung-up on obstacles within the furnace. Many of the newer furnaces now on-line or being built for reclaiming scrap metals contain relatively large melting pits or beds which provide for a more efficient operation. Consequently, the boom needed to handle the material conditioning tool within the furnace must be of considerable length. This, in turn, correspondingly magnifies the effects of stresses or loads induced in the boom in the event it, or the tool secured thereto, is forcefully brought down upon some type of solid instrumentality. Because of its length and its mass, the boom can be easily damaged to a point where it is rendered incapable of carrying out the task for which it was designed.

In the U.S. Pat. No. 4,045,923 there is disclosed a crane boom arrangement wherein an elongated boom section is slidably mounted upon spring-loaded rollers within a stationary gantry so that the boom can be extended or retracted. The rollers are designed to only support the dead weight of the boom to facilitate the repositioning thereof. Bearing pads are provided which are adapted to move into supporting engagement with the boom when the boom experiences any stress or overloading. This, in effect, causes the entire structure to react as a rigid unit to the load, thus making it susceptible to damage.

SUMMARY OF THE INVENTION

It is therefore an object of the present invention to improve apparatus for supporting an elongated tool-handling boom.

A further object of the present invention is to prevent an elongated tool handling-boom from being seriously damaged in the event it, or the tool supported therein, are brought into unwanted contact against a foreign object.

Another object of this invention is to improve apparatus for absorbing shock loads induced into an elongated boom for handling a conditioning tool within a furnace or the like.

Yet another object of the present invention is to prevent an elongated tool-handling boom from becoming damaged when in use while at the same time suspending the boom securely within a support gantry.

These and other objects of the present invention are attained by means of an elongated boom that is adjustably suspended between a rearwardly positioned pivot and a forwardly positioned rest. Both the pivot and the rest are mounted for independent movement within a gantry whereby the position of the rest can be adjusted in reference to the pivot as the boom is extended or retracted within the gantry. The boom is able to be lifted from the rest in the event the boom or the tool secured therein becomes lodged against a foreign object. Shock absorber means are operatively connected to the boom which functions to return the boom to the rest at a controlled rate upon its being lifted therefrom.

BRIEF DESCRIPTION OF THE DRAWING

For a better understanding of these and other objects of the present invention reference is had to the following detailed description to be read in conjunction with the following drawing, wherein.

DESCRIPTION OF THE INVENTION

Figure 1:
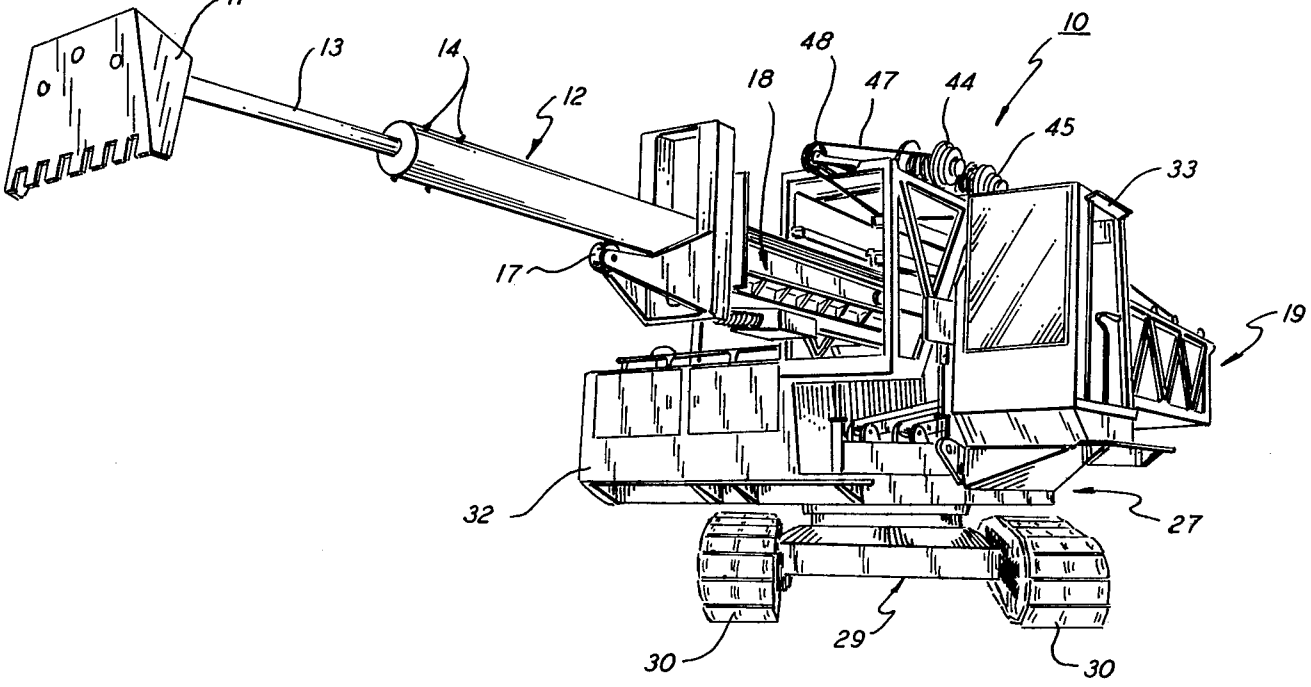
FIG. 1 is a perspective view of a mobile piece of apparatus which contains an extendable boom embodying the teachings of the present invention.
Figure 2:
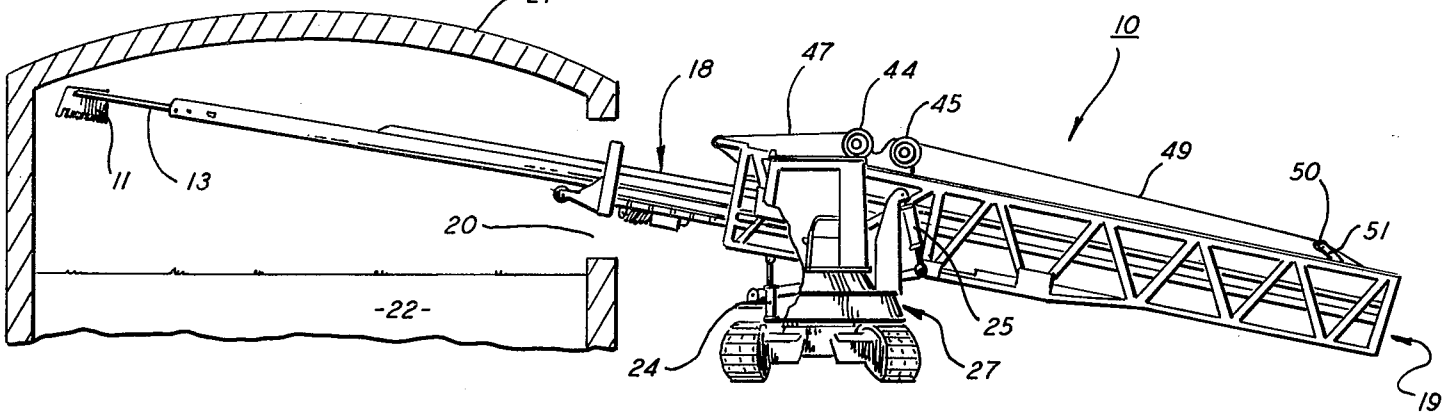
FIGS. 2 and 3 are side elevations of the apparatus shown in FIG. 1 illustrating the boom contained therein extended through the access opening of a furnace.
Figure 3:
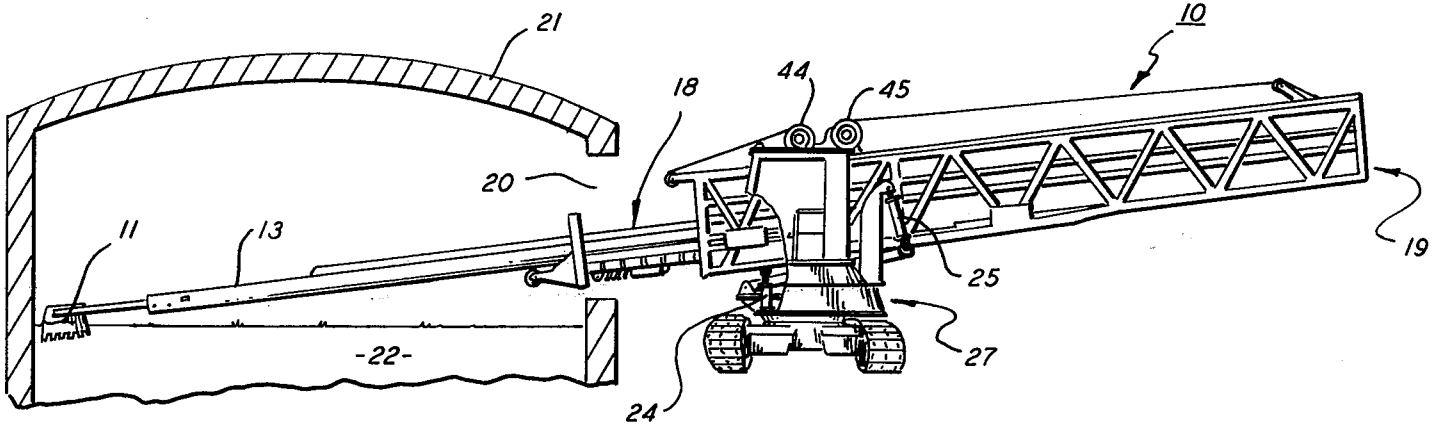

Referring now to the drawings and, in particular, to the FIGS. 1–3, there is shown a mobile piece of apparatus, generally referenced 10, that contains a support system for a tool-handling boom. As will be explained in further detail below, the present boom support is particularly well suited for accommodating a relatively long tool-handling boom within a gantry. The support system permits the elongated boom to be securely retained therein as the boom is extended from a gantry while at the same time preventing the boom and its associated supporting structure from being damaged if the boom, or the tool supported therein, is inadvertently brought down against a foreign object.

Figure 8:
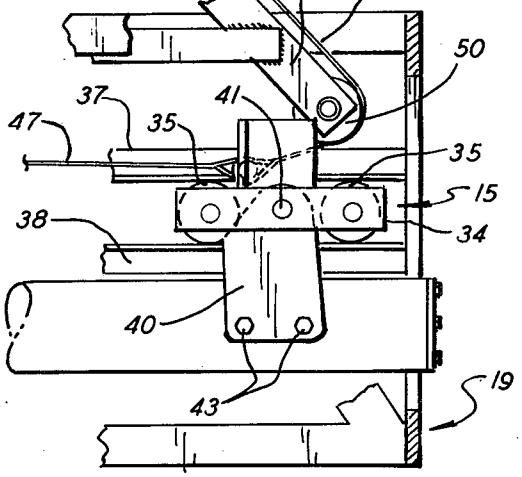
FIG. 8 is a side elevation view of the boom showing the boom suspended between a rearwardly positioned pivot and a forwardly positioned rest.
Figure 8:
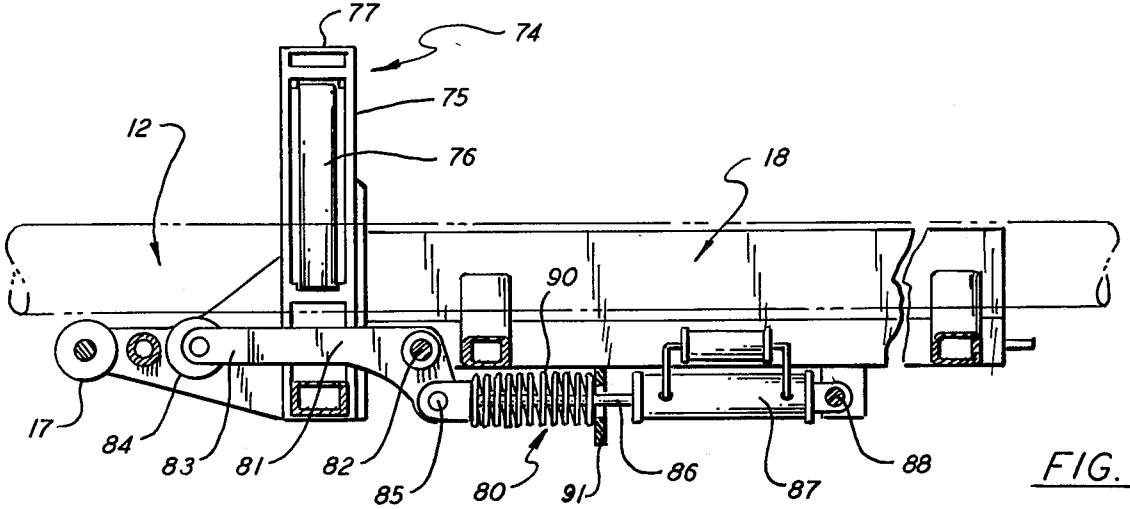

A conditioning tool 11 is secured in the front end of the elongated boom 12 by locking the handle 13 of the tool to the boom using a pair of bolts 14—14. The conditioning tool is typically employed to distribute scrap material within a reclaiming furnace or the like and to skim impurities from the top of the liquid melt developed in the pit of the furnace. As best illustrated in FIG. 8, the back end of the boom is pivotably hung below a movable carriage 15 while the main body thereof is allowed to rest upon a support roll 17 carried within a movable cradle 18. Both the carriage and the cradle are independently positioned within a gantry 19 to maintain the boom in stable suspension as the boom is extended or retracted.

As shown in FIGS. 2 and 3, the boom is adapted to pass the conditioning tool through the access opening 20 of a reclaiming furnace 21 to condition material contained within the pit 22 of the furnace. Forward and rear hydraulic lifters, 24 and 25 respectively, are provided which act between the gantry and the turntable 27 of the apparatus which enables the boom to be tilted above and below the horizon whereupon the elevation of the tool can be altered. As can be seen, the tool or the boom is thus susceptible to being caught upon some object within the furnace as the tool is being brought to a lower elevation. Because of the extensive length of the boom required to service the larger reclaiming furnaces now in use, severe damage can be done to the equipment if the shock or load is not relieved. This potentially dangerous condition, of course, is intensified when the equipment is exposed to extremely high temperatures within the furnace.

In practice, the gantry is adjustably supported as noted upon the gear-driven turntable and the turntable is adapted to revolve in a horizontal plane through 360° of rotation. The turntable is mounted upon a chassis 29 (FIG. 1) that includes a pair of endless treads 30—30 for driving the apparatus universally over the ground. A drive compartment 32 is mounted upon the turntable and houses the mechanical and hydraulic drives for powering the various components of the apparatus. A cab 33 is mounted on the turntable adjacent to the drive compartment which houses the operational controls of the machine. The cab is furnished with a forward-facing transparent heat shield through which the operator can view the conditioning tool.

Figure 6:
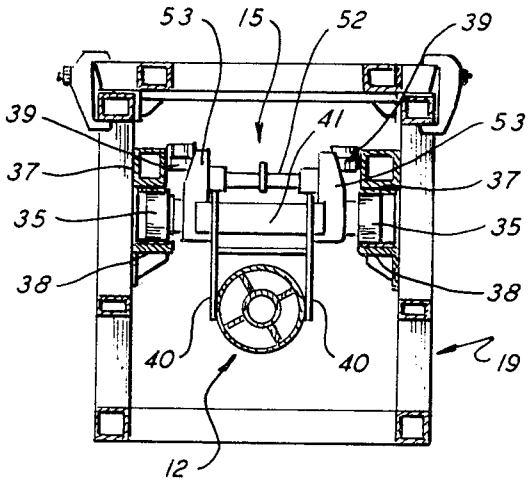
FIG. 6 is an enlarged sectional view taken along lines 6—6 in FIG. 4.
Figure 4:
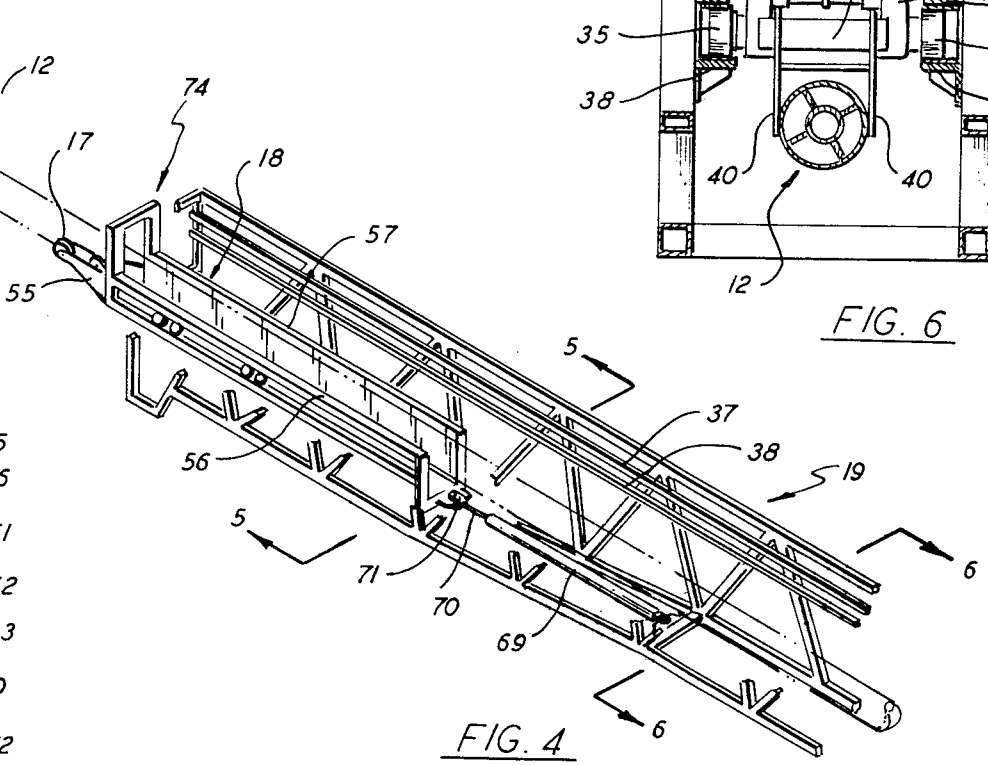
FIG. 4 is a partial perspective view of a gantry in which the boom is movably mounted.

The gantry is fabricated of a plurality of structural elements that are brought together to create a bridge-like structure in which the boom is movably supported. As previously pointed out, the back end of the boom is hung beneath a carriage that is arranged to ride between rails secured to the sidewalls of the gantry. The carriage includes a pair of opposed bogie plates 34—34 in which are mounted wheels 35—35. As best seen in FIGS. 6 and 8, each wheel pair rides between an upper rail 37 and a lower rail 38. In practice the rails are formed of angle irons welded to the gantry so that the horizontal legs thereof are presented to the carriage wheels. Side rollers 30—39 are secured to the gantry frame and ride in contact against the carriage to prevent lateral displacement thereof.

The boom is suspended or hung below the carriage by means of side hangers 40—40 journalled for rotation about a horizontal pivot 41 that is supported between the bogie plates. The hangers are affixed to the back end of the boom via bolts 43—43 (FIG. 8). Through this arrangement, the boom is allowed to swing or rotate in a vertical plane.

The carriage is reciprocally moved over the rails by means of hydraulic winches 44 and 45 (FIGS. 2 and 3) positioned on top of the gantry over the turntable. The forward facing winch 44 is connected to the carriage by a cable 47 that passes over pulley 48 and is brought rearwardly through the front of the gantry. The gear winch 45 is similarly connected to the carriage via cable 49 that is turned over a pair of pulleys 50—50 carried in bracket 51 and passed forwardly through the rear of the gantry. The ends of the two cables are affixed to a shaft 52 that is secured to the carriage by means of two upraised members 53—53. In operation, the winches cooperate to pull the carriage in a desired direction along the rails whereby the boom is caused to be extended or retracted within the gantry.

The main body of the boom extends longitudinally within the gantry and passes outwardly through the front end thereof to position the tool forward of the turntable. The body of the boom is loosely supported in the movable cradle 18 upon a rest 17. In practice the rest is a roll that is journalled for rotation in a bifurcated arm 55. The arm, in turn, is secured to the front of the cradle.

Figure 5:
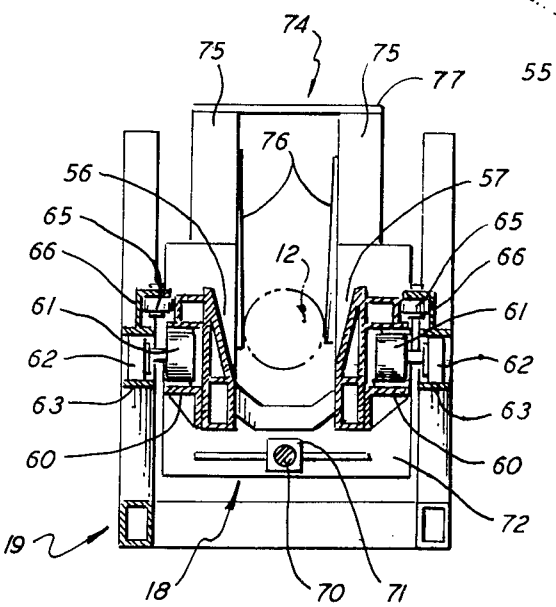
FIG. 5 is an enlarged view taken along lines 5—5 in FIG. 4.

With further reference to FIGS. 4–8, the cradle is a channel-shaped, open-topped structure having two opposed sidewalls 56, 57 that are conjoined by means of lower cross members 58—58. A horizontal slide mechanism 60—60 depends outwardly from each of the sidewalls that is adapted to contain therein a plurality of rollers 61—61. The rollers are stationarily mounted within the gantry by means of bearing blocks 62—62 affixed to brackets 63—63 in the sidewalls thereof as illustrated in FIG. 5. Horizontal side rollers 65—65 are rotatably supported in members 66—66 secured in the sidewalls of the gantry and are adapted to ride in contact with pads 67—67 welded to the sidewalls of the cradle. Here again the side rollers function to limit lateral movement of the cradle as it moves within the gantry.

The cradle is driven back and forth over its prescribed path of travel by a double-acting hydraulic cylinder 69 that is pinned at the lower end in the bottom of the gantry. The extendable arm 70 of the cylinder terminates in a clevis 71 that is pinned in the back wall 72 of the cradle. In operation, the cylinder is able to extend the cradle well forward of the front end of the gantry as illustrated in FIGS. 1–3 to place the roll 17 well out along the extended boom to provide a stable support for the boom structure. As the boom is run into the gantry, the operator can retract the cradle to reposition the support roll 17 into a more optimum support position.

As can be seen from the disclosure above, the boom is supported within the gantry by means of a rear pivot 41 while the front end thereof simply rests within the cradle. As a consequence, the boom can be lifted from the rest and swung upwardly about the pivot. In the event the boom, or the tool supported therein, is brought down against a foreign object as the gantry is being tipped down, the boom will simply come to rest as the gantry continues on a downward path. This, of course, prevents the relatively massive and lengthy boom from being damaged. Also, and maybe just as importantly, this freedom of movement provided to the boom prevents these high stresses from being translated through the boom to the associated machine components.

A yoke, generally referenced 74, is mounted on the front end of the cradle to facilitate the upward movement of the boom. The yoke includes two vertical guides 75—75 located on either side of the boom which have vertical rollers 76—76 journalled for rotation therein. The guides extend upwardly above the top margin of the cradle and prevent undue lateral displacement of the boom in the event it is inadvertently lifted from the support roll. An upper crosspiece 77, which is connected to the vertical guide, serves to limit the vertical travel of the boom.

Figure 7:
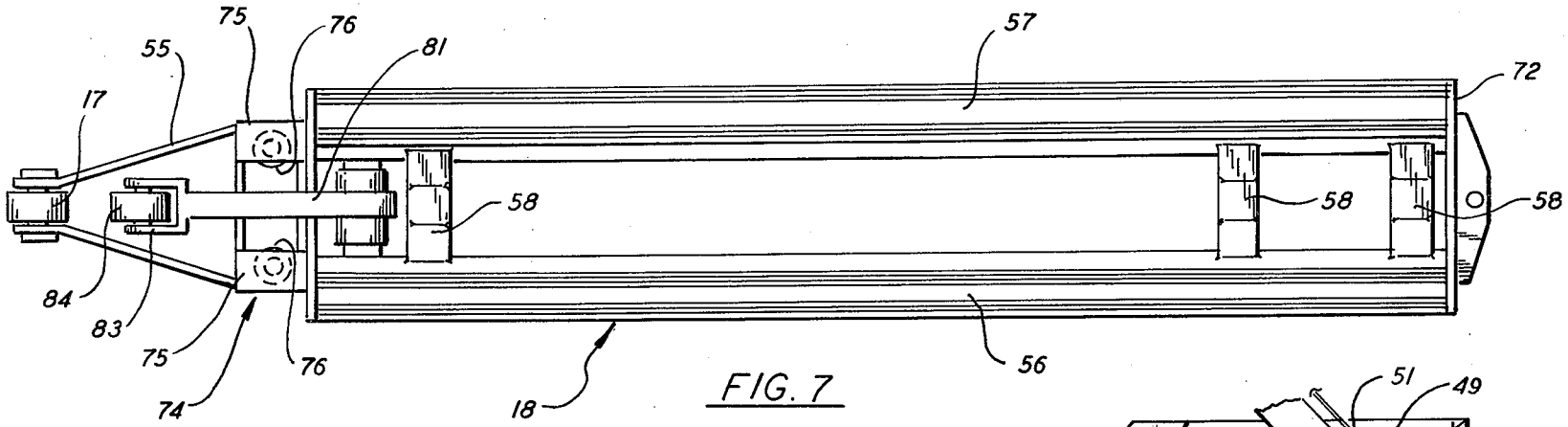
FIG. 7 is an enlarged top view of a movable cradle for supporting a boom rest within the gantry.

A shock absorbing system 80 is mounted beneath the cradle which is able to dampen any sudden loads caused by the heavy boom being released by an obstruction while the boom is elevated some distance above the support roll. As illustrated in FIGS. 7 and 8, the shock absorbing system includes an L-shaped lever arm 81 which is pivotably supported upon a shaft 82 contained in the sidewalls of the cradle. A clevis 83 is provided in the horizontally extended leg of the lever arm which rotatably supports a follower roll 84 therein. The downwardly extended leg of the lever arm is pinned, via pin 85, to the ram arm 86 of a hydraulically actuated shock absorber unit 87. The back end of the unit is secured to the underside of the cradle in a stub shaft 88. A regulator tank is operationally connected into the shock absorber unit by which the operational pressure of the unit can be adjustably controlled.

A compression spring 90 is wound about the ram shaft of the shock absorber unit. The spring is arranged to act between a downwardly extended bracket 91 depending from the cradle and the vertical leg of the lever arm. The spring serves to place a biasing force upon the arm that continually urges the follower roll upwardly into contact with the bottom surface of the boom regardless of the boom's position relative to the forward support roll 17. Upon the boom being lifted from the cradle, the follower roll, under the influence of the spring, will continue to ride in contact against the boom. When the boom is freed, the relatively massive structure will suddenly want to fall back upon the support roll. However, the shock of the falling boom is translated through the shock absorber system and dampened in the absorber unit. As a result, the boom, acting against the absorber unit, is lowered at a controlled rate back onto the support roll such that damage to the equipment is avoided.

While this invention has been described with reference to the structure disclosed herein, it is confined to the details set forth and this application is intended to cover any modifications or changes as may come within the scope of the following claims.

I claim:

1. In a device of the type wherein an elongated boom is supported toward its back end in a pivot whereby the boom is able to rotate in a vertical plane and has a conditioning tool affixed to the front end thereof, apparatus for supporting the body of the boom forward of the pivot that includes a cradle having an open top for encompassing a portion of said body of the boom, a rest mounted in the cradle beneath the boom upon which the boom is able to be seated, a lever arm mounted in the cradle beneath the boom that is arranged to rotate in the same plane as said boom, a follower mounted in one end of the lever arm that is arranged to ride in contact against the bottom of the boom, a spring means acting against the opposite end of the lever arm for biasing the follower against the boom, a shock absorber also arranged to act against the opposite end of the lever arm for dampening downwardly acting loads that are suddenly applied to the follower.

2. The apparatus of claim 1 that further includes means to movably support the cradle beneath the boom whereby the position of the rest may be adjusted in respect to the pivot.

3. The apparatus of claim 1 wherein said shock absorber includes a hydraulic cylinder secured to the cradle having a movable ram secured to the opposite end of the lever arm.

4. The apparatus of claim 3 wherein said spring means is a compression spring wound about the movable ram and being arranged to act against the cradle and the opposite end of the lever arm.

5. The apparatus of claim 1 wherein said follower is a roll that is journalled for rotation in the one end of the lever arm.

6. The apparatus of claim 5 wherein the rest is a second roll journalled for rotation in the cradle.

7. The apparatus of claim 1 that further includes side guides vertically extended from the cradle on either side of the boom to prevent lateral movement of the boom.

8. The apparatus of claim 7 wherein each vertical guide contains a vertically extended roller for moving in contact with the side of said boom.

9. Apparatus suitable for use in running a conditioning tool into and out of a furnace including a horizontally aligned support gantry, a carriage mounted for reciprocal movement within the gantry, an elongated boom mounted at its back end in said carriage by means of a pivot whereby the boom can rotate in a vertical plane and having a conditioning tool secured in the front end thereof, a cradle also mounted for reciprocal movement within the gantry forward of said carriage, said cradle being an open topped structure that encompasses the body of said boom, p1 a rest mounted in the cradle for contacting the bottom of the boom to seat the boom within the cradle whereby the boom can be lifted vertically from said rest, and shock absorber means operatively acting between the cradle and the boom for dampening suddenly applied loads transmitted through said boom.

10. The apparatus of claim 9 that further includes a pair of vertical guides extending upwardly from the cradle on either side of the boom to restrict the lateral movement of said boom in the event it is lifted from the cradle.

11. The apparatus of claim 9 wherein said rest is a support roll mounted in a frame at the front of the cradle.

12. The apparatus of claim 9 wherein said shock absorber means includes a lever arm mounted in the cradle beneath the boom that is arranged to rotate in the same plane as the boom, a follower mounted in one end of the lever arm that is arranged to ride in contact against the bottom of the boom, a spring means arranged to act between the cradle and the opposite end of the lever arm to bias the follower in contact against the bottom of said boom, and a hydraulic shock absorber cylinder affixed to the cradle and having a movable ram secured to said opposite end of the lever arm.

13. The apparatus of claim 12 wherein said spring means is a compression spring wound about the ram of the hydraulic cylinder.

14. The apparatus of claim 12 wherein said follower is a second roll that is journalled for rotation in the lever arm.

* * * * *

UNITED STATES PATENT AND TRADEMARK OFFICE

CERTIFICATE OF CORRECTION

PATENT NO. : 4,239,441

DATED : December 16, 1980

INVENTOR(S) : James J. Maynard

It is certified that error appears in the above-identified patent and that said Letters Patent are hereby corrected as shown below:

Claim 9, Col. 6, line 24, delete "pl"

Signed and Sealed this

Seventh Day of April 1981

[SEAL]

Attest:

RENE D. TEGTMEYER

Attesting Officer

Acting Commissioner of Patents and Trademarks